US007335029B2

(12) United States Patent
Bäckeralf et al.

(10) Patent No.: US 7,335,029 B2
(45) Date of Patent: Feb. 26, 2008

(54) CIRCUIT BOARD WITH SHIELDED CONNECTION

(75) Inventors: Peter Bäckeralf, Brakel (DE); Frank Welzel, Detmold (DE); Jens Willmann, Bünde (DE)

(73) Assignee: Phoenix Contact GmbH & Co. KG (DE)

( * ) Notice: Subject to any disclaimer, the term of this patent is extended or adjusted under 35 U.S.C. 154(b) by 0 days.

(21) Appl. No.: 11/553,612

(22) Filed: Oct. 27, 2006

(65) Prior Publication Data

US 2007/0099444 A1 May 3, 2007

(30) Foreign Application Priority Data

Oct. 29, 2005 (DE) ..... 10 2005 051 940

(51) Int. Cl.
*H01R 12/00* (2006.01)

(52) U.S. Cl. ..... 439/67; 439/98

(58) Field of Classification Search ..... 439/67, 439/449, 460, 464, 470, 471, 451, 452; 361/816, 361/818, 752–753, 807–810, 730, 728; 174/84 C
See application file for complete search history.

(56) References Cited

U.S. PATENT DOCUMENTS 3,743,748 A * 7/1973 Reeder ..... 174/75 C
6,345,994 B1 * 2/2002 Johnson ..... 439/95
6,717,797 B1 * 4/2004 Martin et al. ..... 361/601

* cited by examiner

*Primary Examiner*—Edwin A. Leon
(74) *Attorney, Agent, or Firm*—Bourque and Associates

(57) ABSTRACT

A combination circuit board and clamping device includes a circuit board having a conductor strip that conducts electrical voltage. A connection for a shielded cable with a device to clamp the cable sheath is provided on the circuit board. This device is in contact with the conductor strip carrying the electrical voltage. The clamp device for the cable sheath consists of a contact piece with a metallic base plate and clamp springs that project on one side and are separated from one another, between which the cable insulated up to the cable sheath is received. The circuit board includes pass-through apertures into which to insert these clamp springs, and the contact piece with the cable end secured between contact springs is attached to the circuit board by means of a cable binder, for whose proper positioning the circuit board includes openings.

5 Claims, 2 Drawing Sheets

CIRCUIT BOARD WITH SHIELDED CONNECTION

TECHNICAL FIELD

The invention concerns a circuit board with a connection for a shielded cable.

BACKGROUND INFORMATION

It is known to provide plug connectors for shielded connection in circuit boards such that mutually engaging plug connections are provided on the circuit board and on the cable end. Further, cable connectors exist directly on the circuit board itself whereby threaded clamp devices are provided to provide contact with the cable sheath that may be incorporated with the stress relief. Handling for these cable connectors is complicated in that the cable prepared for connection with exposed cable sheath must be inserted through a completely enclosed sheath receptor, whereby there exists the danger that the cable sheath will be pushed back and not remain in the optimum position for good contact.

A circuit board with a connector device for a shielded cable is known from document EP 0 586 841 A1. For this, a metallic grounding plate is positioned on the circuit board that includes a metallic spring clamp with a conductor-receptor area in the approximate shape of a half-shell. The cable to be connected is inserted radially into the receptor area up to the cable sheath with its area to be insulated, and can be secured by means of a cable binder as necessary. For this purpose two slot-shaped recesses are positioned within the ground plate parallel to the axis of the half-shell shaped receptor area toward the conductor-insertion direction, through which the cable binder is inserted such that it grasps the spar between the recesses from below and the cable with its sheath from above.

A sheath with rapid connection is known from the Catalog "Phoenix Contact, Over-voltage protection TRABTECH 2000, page 73" that serves to provide the connection of cable sheaths in an electrical cabinet. This rapid sheath connector consists of a contact piece with a metallic base plate and clamp springs that project on one side and are separated from one another, between which the cable insulated up to the cable sheath is received. The cable end and the rapid sheath connector are held together by means of a cable binder, and the sheath with its potential is transformed into a single conductor that contacts the rapid sheath connector.

A cable binder is known from document DE 42 27 796 A1 by means of which a shielded cable may be attached to a circuit board. A U-shaped eyelet [within whose interior the cable insulated up to the cable sheath is received] is positioned on one end of the cable binder. This eyelet is mounted with the open side facing the circuit board in that the cable binder is inserted through apertures in the circuit board, and its free end is arrested by the eyelet. By means of spring legs in the bracket, the cable with its sheath is tensioned against a contact surface positioned in the area of the resting surface of the cable on the circuit board.

SUMMARY

It is the task of the invention to provide a circuit board of the type mentioned at the outset on which, if necessary, the clamp device for the cable sheath may be mounted and which simultaneously ensures meaningful contact between the clamp device and the cable sheath on the one hand, and with the clamp device and the conductor strip of the circuit board on the other hand.

It is not essential for the invention that the sheath connector is provided on the circuit board from the outset, as it may be provided later. Handling of the sheath connector is thus very simple because of the fact that the cable with its exposed sheath is to be inserted along its radial direction between the clamp springs, and resultantly is received between the clamp springs whereby contact with the conductor strip of the circuit board carrying the compensating potential results via the base plate that is of one piece with the clamp springs. The cable connector that is slung on the upper side of the circuit board over the cable, and slung on the underside over the base plate for the clamp springs, is very easy to mount, allows only a pull and not an opening of the sling formed, and is easy to operate and particularly reliable, especially against vibration. Thus, on the one hand, the cable with its sheath is in contact with the clamp springs on the upper side of the circuit board, and on the other, the base plate on the lower side of the circuit board is held in firm contact with the conductor strip carrying the compensating voltage located there.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
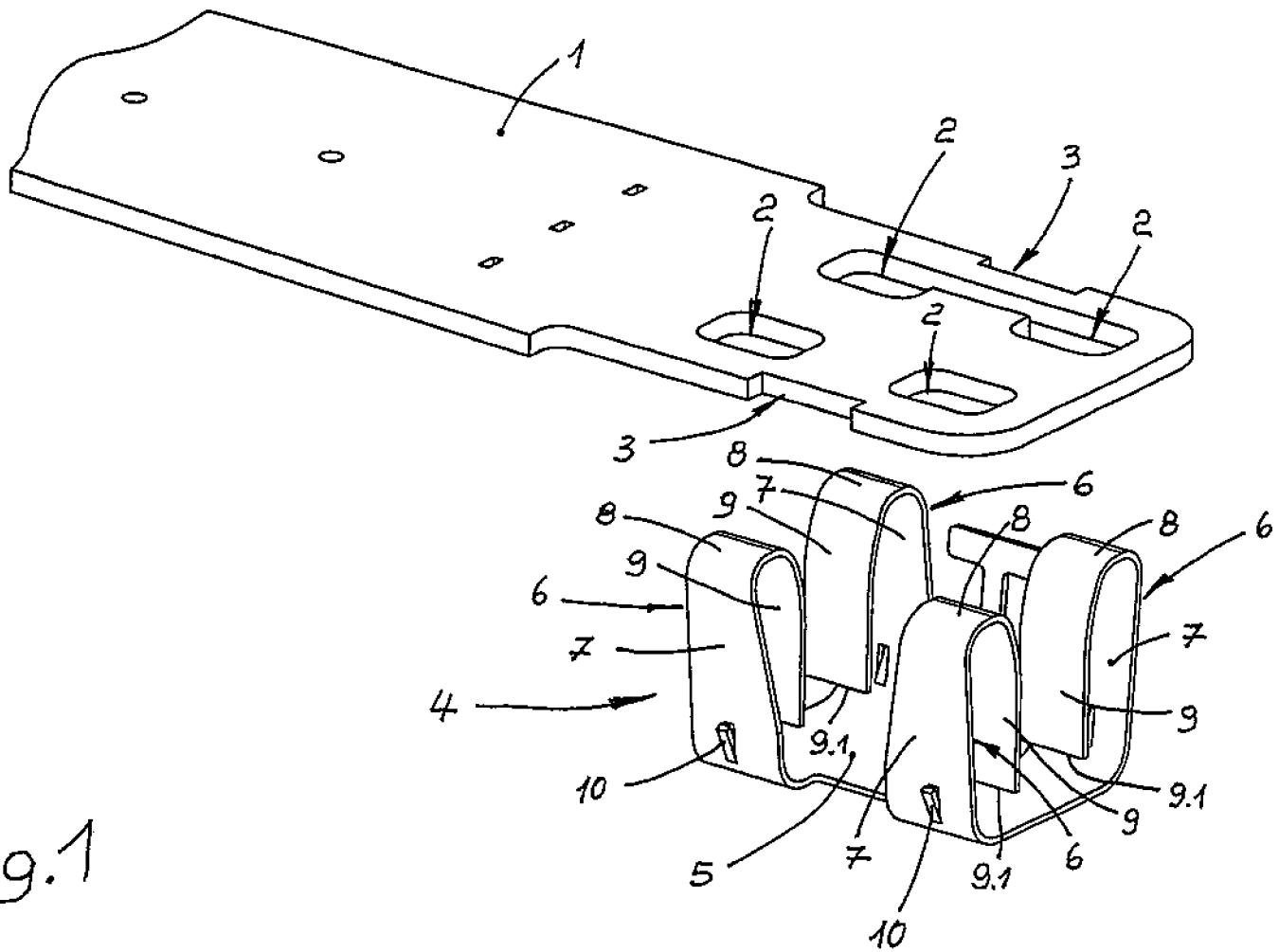
FIG. 1 is a perspective view of the end of a circuit board prepared for a shielded connector, and the contact piece for the shielded connector that may be placed upon it.

In particular, FIG. 1 shows a circuit board 1 without configuration with electrical and/or electronic components. On the end shown in the Figure, the circuit board 1 is first provided with pass-through apertures 2 that are arranged according to a particular pattern, as will be seen from the following. Further, there are recesses 3 near the pass-through apertures 2 along the edge of the circuit board 1 that may be otherwise configured as openings, as will be explained under the purpose of the recesses 3 below.

A contact piece 4 may be placed on the circuit board 1. As is shown in FIG. 1, it is in a position separated from the circuit board 1. The contact piece 4 is a single metallic piece, and includes a flat base plate 5. The base plate 5 possesses a square or rectangular profile, and two strip-shaped clamp springs 6 are formed on two opposing sides of the base plate 5 extending away from the board corners along the longitudinal dimension of the board, across from which clamp springs 6 are positioned along the cross dimension of the board at a distance. The clamp springs 6 extending on the same side of the base plate 5 each include a leg 7 rising from the base plate 5 that is transformed into a clamp leg 9 by means of a bent link 8. The two clamp legs 9 of the clamp springs 6 opposite each other in pairs at a distance along the cross dimension of the base plate 5 form a clamping point.

The above-mentioned hole pattern of the pass-through apertures 2 in the circuit board 1 corresponds to the positions of the clamp springs 6 in the area of the four corners of the base plate 5 of the contact pieces 4. Thus, the contact piece 4 with its clamp springs 6 may extend from the underside through the pass-through apertures 2 until the base plate 5 of the contact piece 4 rests against the underside of the circuit board 1 and there contacts a conductor strip not shown in the Figure. In assembled position, the lower ends 9.1 of the clamp legs 9 of the clamp springs 6 are located above the upper side of the circuit board 1 at a distance, so that the motion of the clamp leg 9 is not hindered.

A spring tongue 10 projects outward on the outer side of the leg 7 rising from the base plate 5 of each contact piece 4. Depending on whether the free end of this tongue 10 as shown is in the upper or lower position, the tongue may function either as an engaging element or as a clamping element.

In the positioning of the contact pieces 4 on the circuit board 1, the edges of the pass-through apertures 2 on the upper side of the circuit board 1 grasp behind or over the tongues 10 on the contact springs 6.

Figure 2:
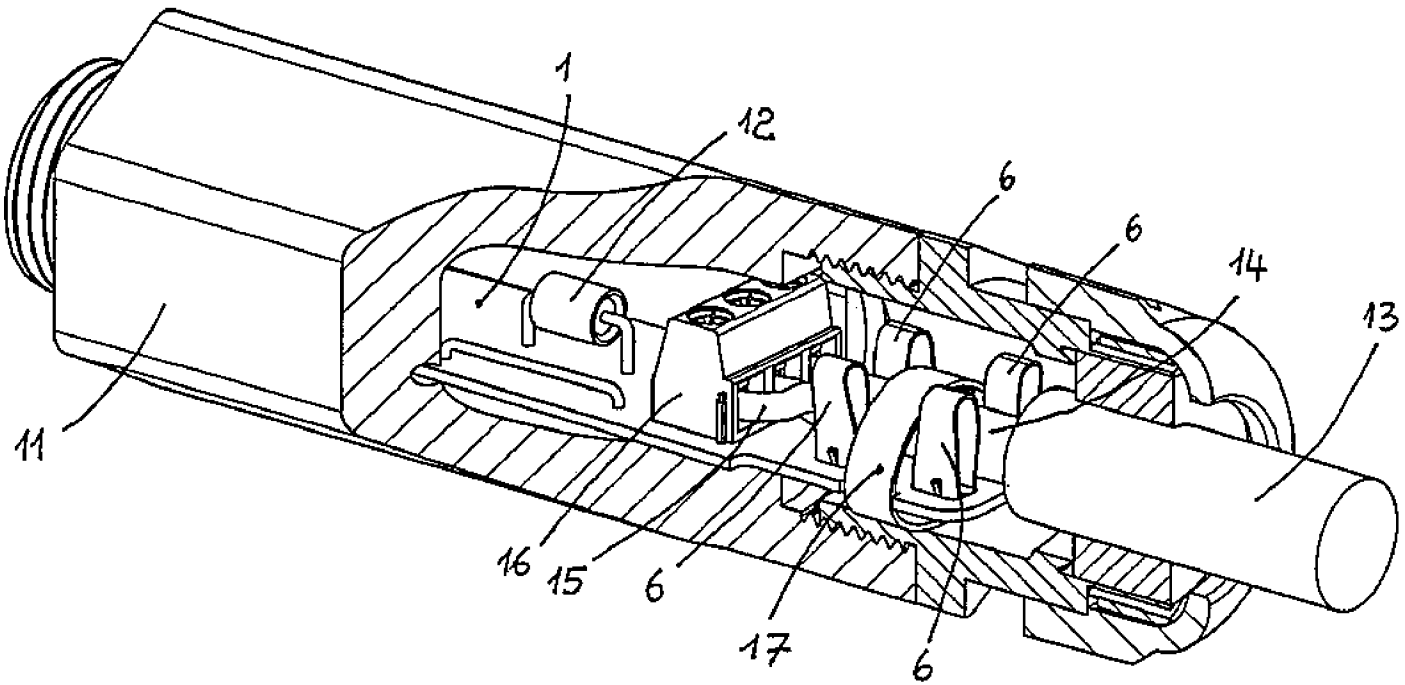
FIG. 2 is a perspective view of the installation position of the circuit board provided with the shielded cable connected to it in accordance with the present invention.

FIG. 2 shows the assembled position of circuit board 1 and contact piece 4. The circuit board 1 including the contact piece 4 is mounted within a tube-shaped housing 11 such as are provided for over-voltage devices of certain design. Thus, the circuit board 1 is provided with components of such a device including an over-voltage conductor 12. A shielded cable 13 is inserted on its face end of the housing that carries with it a coaxial sheath or core under an outer insulating sheath. The spring tongues 6 of the contact piece 4 positioned in pairs across from one another form between themselves the clamp points for the cable core or sheath 14, and correspondingly the cable 13 in the area of these clamp points has its insulation stripped up to the cable core sheath 14. The additional electrical conductors 15 of the cable 13 are connected to a row clamp 16.

The separation of the clamp springs 6 of the contact piece 4 positioned in pairs across from one another is matched to the diameter of the cable 13 with its insulation stripped up to the cable core sheath 14 such that the clamp leg 9 of the clamp springs 6 rests against the cable core sheath 14 with sufficient mechanical clamp tension. The portion of the cable 13 with its insulation stripped up to the cable core sheath 14 is inserted toward the clamp points of the contact piece 4 along its radial direction, while simultaneously securing of the cable section with the exposed cable core sheath 14 to the clamp points and the base plate 5 of the contact piece 4 on the circuit board 1.

A cable binder 17 is provided for this purpose that normally consists of a cross-ribbed plastic strip whose one end includes an eyelet through which the other end may be inserted. The ribbing of the strip and a matching ratchet pawl within the eyelet are so matched to each other that the loop of the cable binder can only be contracted, and cannot be expanded. The cable binder 17 is routed on the upper side of the circuit board between the two pairs of clamp springs 6 and over the cable section with the exposed cable sheath 14. The recesses 3 on the circuit board 1 correspondingly lie with their connecting line between the pass-through apertures 6 of the circuit board 1, each of which is provided for one of the pair of clamp springs 6 on the contact piece 4. The mounted cable binder 17 is routed through these recesses 3 and grasps the base plate 5 of the contact piece under the lower side of the circuit board 1. In this manner, two securing functions are achieved. First, the cable section with the exposed cable sheath 14 is secured at both clamp points between the clamp springs 6 of the contact piece 4 on the upper side of the circuit board 1, and second, the cable binder 17 holds the base plate 5 of the contact piece 4 firmly against the underside of the circuit board 1 in order to contact the conductor strip located there. The cable core sheath 14 of the connected cable 13 is in contact with this conductor strip via the contact piece 4 that carries [first potential] in the case of an over-voltage protective device.

Modifications and substitutions by one of ordinary skill in the art are considered to be within the scope of the present invention, which is not to be limited except by the following claims.

The invention claimed is:

1. A combination circuit board and clamping device for coupling shielded electrical cable having an electrical conductor core surrounded by a cable shield, the circuit board and clamping device combination comprising:

an electrical cable clamping device for the cable comprising a contact piece having a metallic base plate that includes at least one pair of oppositely disposed metallic clamp springs that project from opposite sides of the metallic base plate at a distance from each other, and a circuit board having first and second surfaces, said second circuit board surface having an electrical conductor configured for connecting with said electrical cable shield, said circuit board further including at least one pair of pass-through apertures providing openings from said second to said first circuit board surfaces and through which the at least one pair of clamp springs from said electrical clamping device are inserted, and having the at least one pair of clamp springs inserted from the second side through the pass-through apertures of the circuit board such that the metallic base plate of the clamping device is in electrical contact with the electrical conductor on the second surface of the circuit board such that the electrical cable shield is electrically connected to the electrical conductor on the second surface of the circuit board by being inserted between the at least one pair of clamp springs passing through the apertures of the circuit board.

2. The combination circuit board and clamping device as in claim 1, wherein the at least one pair of clamp springs are formed as leg springs as one piece with the metallic base plate of the contact piece, and include on their upper end away from the base plate a bent link to which a clamp leg pointing toward the base plate is connected, whereby each pairs of the at least two pairs of the clamp springs are mounted on the base plate with their legs pointing inwardly toward each other.

3. The combination circuit board and clamping device as in claim 2 wherein said clamp springs includes legs and further including deformable tongues on an outside surface of the legs of the clamp springs rising from the base plate of the contact piece, said deformable tongues configured to grasp behind edges of the pass-through apertures on the first surface of the circuit board.

4. The combination circuit board and clamping device as in claim 2, wherein said electrical cable clamping device includes at least two pairs of clamp springs, and wherein the at least two pairs of clamp springs are mounted in pairs, each on opposing sides of the base plate of the contact piece, forming a clamp point between them.

5. The combination circuit board and clamping device as in claim 4 further including a cable binder inserted between the adjacent pairs of clamp springs of the clamping device, for securing said electrical cable to said electrical cable clamping device and said circuit board.

* * * * *